US011120756B2

(12) United States Patent
Aburazaki

(10) Patent No.: US 11,120,756 B2
(45) Date of Patent: Sep. 14, 2021

(54) LIQUID CRYSTAL PANEL

(71) Applicant: SHARP KABUSHIKI KAISHA, Sakai (JP)

(72) Inventor: Kazuyuki Aburazaki, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/986,138

(22) Filed: Aug. 5, 2020

(65) Prior Publication Data

US 2021/0049972 A1 Feb. 18, 2021

Related U.S. Application Data

(60) Provisional application No. 62/885,420, filed on Aug. 12, 2019.

(51) Int. Cl.
*G09G 3/36* (2006.01)

(52) U.S. Cl.
CPC ..... *G09G 3/3614* (2013.01); *G09G 3/3648* (2013.01); *G09G 2320/0247* (2013.01)

(58) Field of Classification Search
CPC combination set(s) only.
See application file for complete search history.

(56) References Cited

U.S. PATENT DOCUMENTS

2011/0211145 A1* 9/2011 Tsuruma ..... G02F 1/134363 349/106
2015/0200549 A1* 7/2015 Michisaka ..... H02J 50/80 307/31
2017/0302167 A1* 10/2017 Horiuchi ..... H02M 3/1582
2019/0339577 A1* 11/2019 Hatsumi ..... G02F 1/134363

FOREIGN PATENT DOCUMENTS

JP 2011-203681 A 10/2011

* cited by examiner

*Primary Examiner* — Van N Chow
(74) *Attorney, Agent, or Firm* — ScienBiziP, P.C.

(57) ABSTRACT

A liquid crystal panel includes a liquid crystal layer, a pixel electrode, and a common electrode. In a case where the AC voltage of a certain amplitude is supplied to the pixel electrode, an optimum common voltage fluctuates from a first optimum common voltage to a second optimum common voltage, the optimum common voltage being the common voltage that minimizes a transmittance difference between the transmittance of the pixel before a reversal of polarity of the pixel voltage and the transmittance of the pixel after the reversal of polarity of the pixel voltage. The common voltage is a voltage that is higher than the first optimum common voltage and lower than the second optimum common voltage or a voltage that is lower than the first optimum common voltage and higher than the second optimum common voltage.

4 Claims, 7 Drawing Sheets

LIQUID CRYSTAL PANEL

CROSS-REFERENCE TO RELATED APPLICATION

The present application claims priority from Provisional Application No. 62/885,420, the content to which is hereby incorporated by reference into this application.

BACKGROUND OF THE INVENTION

1. Field of the Invention

The following disclosure relates to a liquid crystal panel that a liquid crystal display device includes.

2. Description of the Related Art

A liquid crystal display device displays an image by controlling a pixel voltage that is applied to liquid crystals for each pixel and controlling a light transmittance (hereinafter referred to simply as "transmittance") for each pixel. In such a liquid crystal display device, a pixel voltage whose polarity is reversed in a predetermined cycle is applied to liquid crystals, as the continuous application to the liquid crystals of a pixel voltage of the same polarity leads to deterioration of the liquid crystals.

Normally, in a liquid crystal display device, an AC voltage is supplied to a pixel electrode provided for each pixel. Further, a common voltage of a certain magnitude is supplied to a common electrode commonly provided for a plurality of pixels. In general, an optimum value (optimum common voltage) of the common voltage is a value that minimizes a transmittance difference between a transmittance of a pixel before a reversal of polarity of a pixel voltage and the transmittance of the pixel after the reversal of polarity of the pixel voltage in a case where an AC voltage of a certain amplitude is supplied to a pixel electrode.

However, when use of the liquid crystal display device entails an uneven distribution of impurity ions in a liquid crystal layer, the optimum common voltage fluctuates. Moreover, when a voltage that is supplied to the common electrode greatly diverges from the optimum common voltage, the absolute value of the pixel voltage greatly fluctuates every time the polarity of the pixel voltage is reversed. Then, the transmittance difference between the transmittance of the pixel before the reversal of polarity of the pixel voltage and the transmittance of the pixel after the reversal of polarity of the pixel voltage becomes greater, and there may occur a problem such as a flickering screen.

To address this problem, for example, Japanese Unexamined Patent Application Publication No. 2011-203681 proposes a liquid crystal display device that measures a DC voltage that is generated by impurity ions or the like in a liquid crystal layer and superimposes, onto a pixel electrode, an offset voltage that cancels out the DC voltage. However, this liquid crystal display device is intricate in construction, as it needs an electrode and a device to measure a DC voltage that is generated by impurity ions or the like. Moreover, this liquid crystal display device involves complicated arithmetic processing, as it needs to calculate an offset voltage.

SUMMARY OF THE INVENTION

In order to solve the foregoing problem, one embodiment of the present invention is directed to a liquid crystal panel including: a liquid crystal layer having liquid crystals; a pixel electrode, provided for each pixel, to which an AC voltage is supplied; and a common electrode to which a common voltage of a certain magnitude is supplied, wherein a transmittance of the pixel is controlled by the pixel electrode and the common electrode controlling a pixel voltage that is applied to the liquid crystal layer, in a case where the AC voltage of a certain amplitude is supplied to the pixel electrode, an optimum common voltage fluctuates from a first optimum common voltage to a second optimum common voltage, the optimum common voltage being the common voltage that minimizes a transmittance difference between the transmittance of the pixel before a reversal of polarity of the pixel voltage and the transmittance of the pixel after the reversal of polarity of the pixel voltage, and the common voltage is a voltage that is higher than the first optimum common voltage and lower than the second optimum common voltage or a voltage that is lower than the first optimum common voltage and higher than the second optimum common voltage.

The liquid crystal panel thus configured makes it possible to, even if the optimum common voltage fluctuates, make the transmittance difference between the transmittance of the pixel before the reversal of polarity of the pixel voltage and the transmittance of the pixel after the reversal of polarity of the pixel voltage smaller than it is in a case where the common voltage is the first optimum common voltage. This makes it possible to reduce a flickering screen and a display unevenness on the liquid crystal panel.

BRIEF DESCRIPTION OF DRAWINGS

An embodiment of the present invention is described in detail below with reference to the drawings. Components that are the same as or equivalent to each other throughout the drawings are given the same reference signs and are not repeatedly described. For simplicity of description, the drawings to be referred to below simplistically or schematically illustrate configurations or omit to illustrate some constituent members. Further, the dimensional ratio of one constituent member to another as shown in each drawing is not necessarily intended to indicate an actual dimensional ratio.

Figure 1:
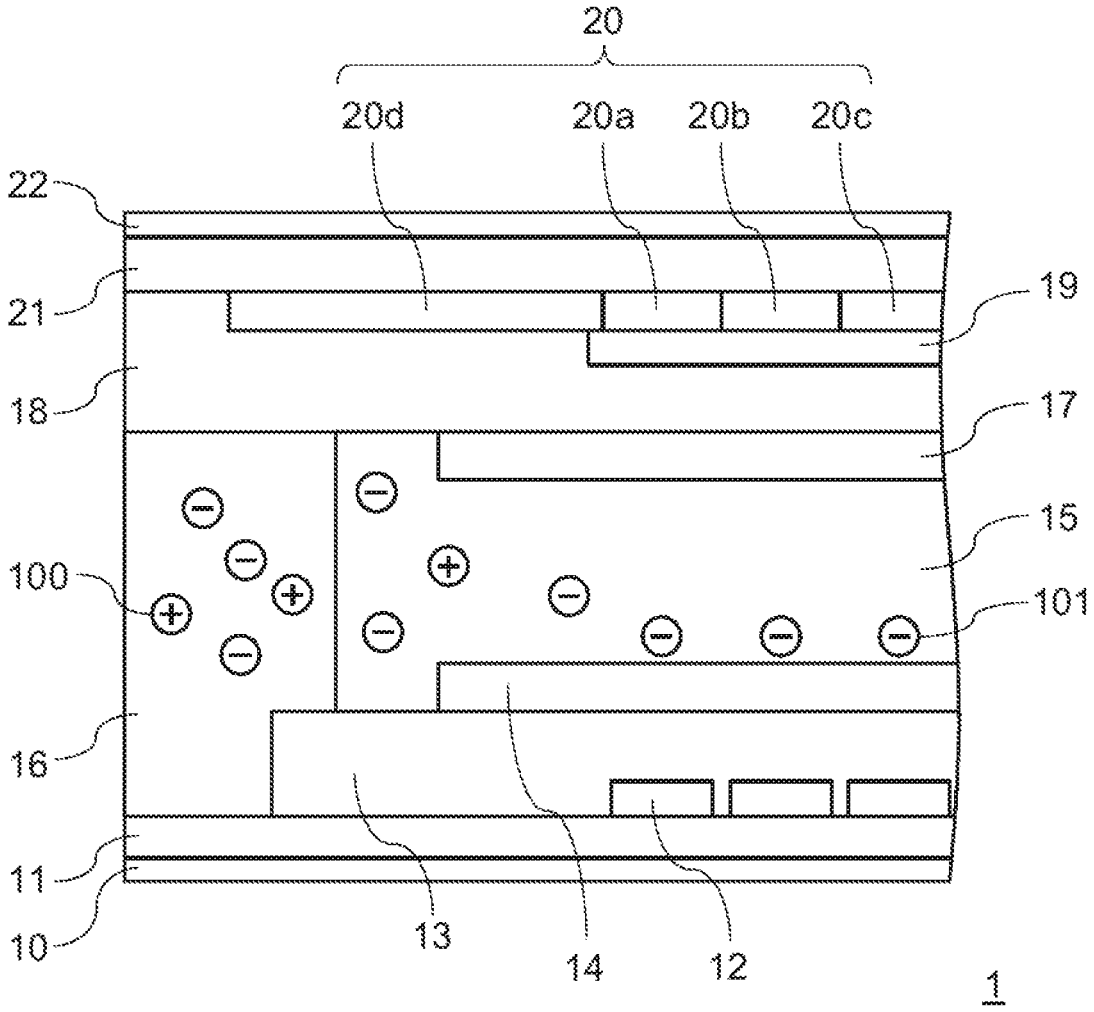
FIG. 1 is a schematic cross-sectional view schematically showing a configuration of a liquid crystal panel 1 according to the present embodiment.

First, a configuration of a liquid crystal panel 1 according to the present embodiment is described. FIG. 1 is a schematic cross-sectional view schematically showing the configuration the liquid crystal panel 1 according to the present embodiment. As shown in FIG. 1, the liquid crystal panel 1 includes a lower polarizing plate 10, a lower glass substrate 11, a pixel electrode 12, an insulating film 13, a lower alignment film 14, a liquid crystal layer 15, a seal 16, an upper alignment film 17, an overcoat film 18, a common electrode 19, color filters 20*a* to 20*d*, an upper glass substrate 21, and an upper polarizing plate 22. In the following, the term "upward" refers to the direction of the upper polarizing plate 22 as seen from the lower polarizing plate 11 in the liquid crystal panel 1, and the term "downward" refers to the opposite direction. In a case where the liquid crystal panel 1 is applied to a transmissive liquid crystal device, a backlight that emits light upward is provided below the liquid crystal panel 1.

The liquid crystal panel 1 shown in FIG. 1 is of an active matrix type. The liquid crystal panel 1 illustrated is driven under a driving scheme, such as a VA (vertical alignment) scheme or a TN (twisted nematic) scheme, for driving by supplying a longitudinal (vertical) field to liquid crystals, but may alternatively be a liquid crystal panel that is driven under a driving scheme, such as an IPS (in-plane switching) scheme or an FFS (fringe field switching) scheme, for driving by supplying a transverse field to liquid crystals.

The lower polarizing plate 10 is disposed below the lower glass substrate 11. The pixel electrode 12 is formed on an upper surface of the lower glass substrate 11. The insulating film 13 is formed over the lower glass substrate 11 so as to cover the pixel electrode 12. The lower alignment film 14 is formed on an upper surface of the insulating film 13.

The upper polarizing plate 22 is disposed above the upper glass substrate 21. The color filter 20 is formed on a lower surface of the upper glass substrate 21. For example, the color filter 20 has a configuration in which a filter 20*a* that transmits blue light, a filter 20*b* that transmits green light, and a filter 20*a* that transmits blue light are arrayed in a predetermined pattern (e.g. a stripe array or a mosaic array). Further, the color filter 20 has, in a frame part or the like that does not constitute pixels, a black filter 20*d* (black matrix) that blocks light.

The common electrode 19 is formed on a lower surface of the color filter 20. The overcoat film 18 is formed under the upper glass substrate 21 so as to cover the color filter 20 and the common electrode 19 under the upper glass substrate 21. The upper alignment film 17 is formed on a lower surface of the overcoat film 18. Further, the seal 16 is provided around the liquid crystal layer 15. In the case of a liquid crystal panel that is driven under a driving scheme for driving by applying a transverse field to liquid crystals, the common electrode 19 may be formed below the liquid crystal layer 15 (e.g. on the upper surface of the lower glass substrate 11) instead of being formed above the liquid crystal layer 15.

The pixel electrode 12 is provided for each pixel of the liquid crystal panel 1. Similarly, each of the filters 20*a* to 20*c* is provided for each pixel of the liquid crystal panel 1. The lower polarizing plate 10 transmits light that oscillates in a first direction, and the upper polarizing plate 22 transmits light that oscillates in a second direction. The lower alignment film 14 and the upper alignment film 17 each has a groove for uniforming the orientation of liquid crystals contained in the liquid crystal layer 15.

The following describes how the liquid crystal panel 1 according to the present embodiment operates. In the liquid crystal panel 1 according to the present embodiment, light is emitted from the backlight provided below the lower polarizing plate 10. The lower polarizing plate 10 selectively transmits a component of the light emitted by the backlight that oscillates in the first direction.

The orientation of the liquid crystals contained in the liquid crystal layer 15 is controlled by a pixel voltage that is applied by the pixel electrode 12 and the common electrode 19. The direction of oscillation of the light transmitted by the lower polarizing plate 10 is controlled according to the orientation of the liquid crystals contained in the liquid crystal layer 15. The filters 20*a* to 20*c* selectively transmit a component of a particular wavelength (color) of light transmitted by the liquid crystal layer 15. The upper polarizing plate 22 selectively transmits a component of the light transmitted by the filters 20*a* to 20*c* that oscillates in the second direction.

A method by which the liquid crystal panel 1 displays an image is described here by taking, as examples, a case where the first direction, which is a component of the direction of oscillation of light that the lower polarizing plate 10 transmits, and the second direction, which is a component of the direction of oscillation of light that the lower polarizing plate 22 transmits, are perpendicular and a case where the first direction and the second direction are parallel.

In a case where the first direction and the second direction are perpendicular, light having a component transmitted by the lower polarizing plate 10 that oscillates in the first direction is transmitted by the upper polarizing plate 22 when the direction of oscillation of the light is changed by the liquid crystals. Meanwhile, light having a component transmitted by the lower polarizing plate 10 that oscillates in the first direction is blocked (absorbed) by the upper polarizing plate 22 if the direction of oscillation of the light is not changed by the liquid crystals.

In a case where the first direction and the second direction are parallel, light having a component transmitted by the lower polarizing plate 10 that oscillates in the first direction is blocked (absorbed) by the upper polarizing plate 22 when the direction of oscillation of the light is changed by the liquid crystals. Meanwhile, light having a component transmitted by the lower polarizing plate 10 that oscillates in the first direction is transmitted by the upper polarizing plate 22 if the direction of oscillation of the light is not changed by the liquid crystals.

Note here that whether the direction of oscillation of light is changed by liquid crystals is determined by the orientation of the liquid crystals. Further, the orientation of liquid crystals is controlled by the magnitude of a pixel voltage. Accordingly, a transmittance of a pixel is controlled by a pixel voltage. Moreover, the liquid crystal panel 1 displays an image by controlling a transmittance of each of the pixels.

Figure 2:
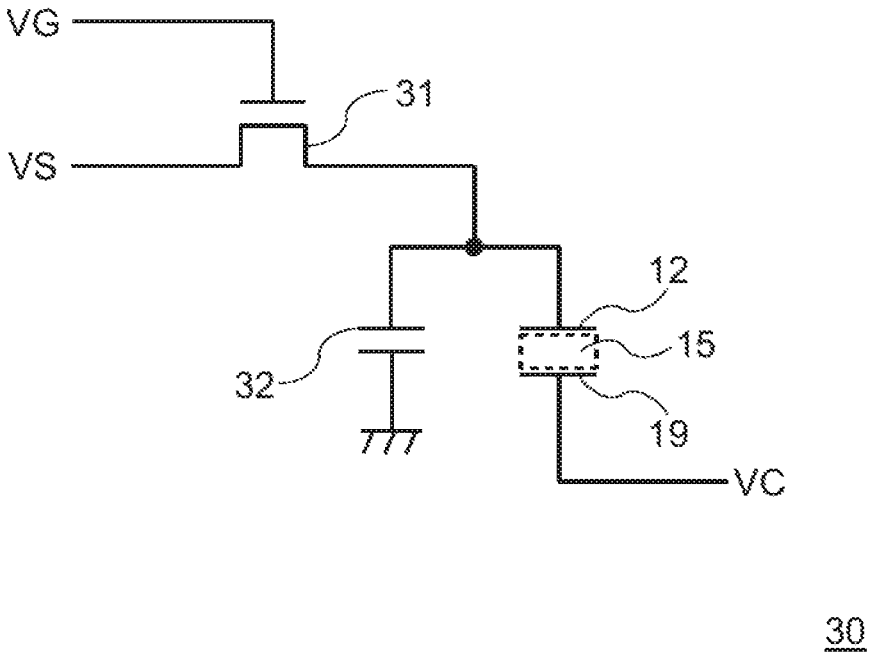
FIG. 2 is a circuit diagram of a pixel circuit 30.

The following describes a pixel circuit 30 that applies a pixel voltage to the liquid crystal layer 15. FIG. 2 is a circuit diagram of the pixel circuit 30. Note that the circuit shown in FIG. 2 is a circuit equivalent to the pixel circuit 30.

As shown in FIG. 2, the pixel circuit 30 includes a TFT (thin-film transistor) 31, an auxiliary capacitor 32, a pixel electrode 12, and a common electrode 19. The TFT 31 is constituted, for example, by an n-channel FET. The TFT 31 has a gate to which a gate voltage VG is supplied and a source to which a source voltage VS is supplied. The TFT 31 has a drain connected to a first end of the auxiliary capacitor 32 and to the pixel electrode 12. A second end of the auxiliary capacitor 32 is grounded. Further, a common voltage VC is supplied to the common electrode 19.

Figure 3:
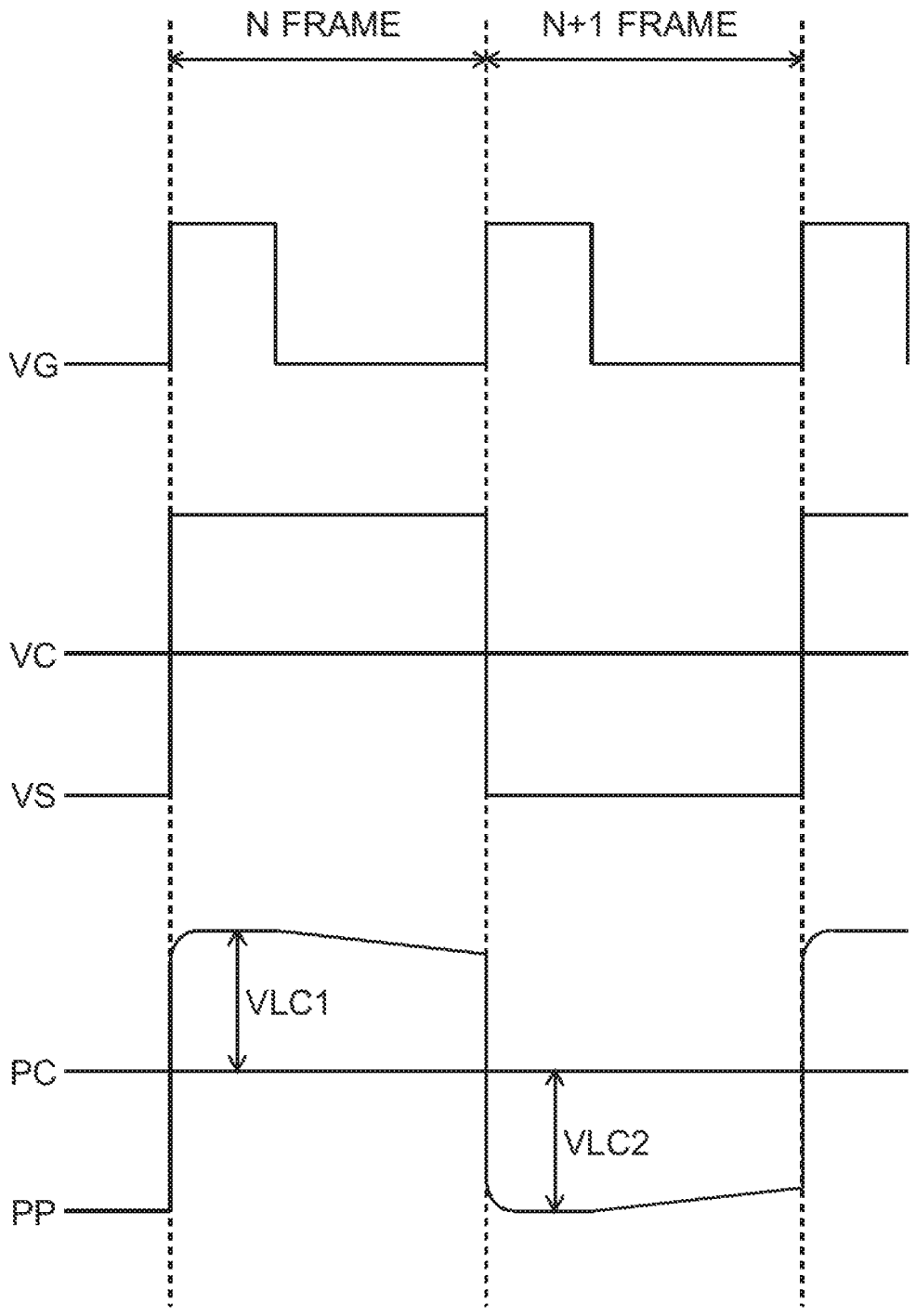
FIG. 3 is a timing chart showing an example of how the pixel circuit 30 is driven.

An example of how the pixel circuit 30 is driven is described with reference to the drawings. FIG. 3 is a timing chart showing an example of how the pixel circuit 30 is driven. Note that FIG. 3 is simplistically illustrated by omitting, for example, a feedthrough voltage that is generated due to a parasitic capacitance of the TFT 31. Further, in FIG. 3, PP denotes the electric potential of the pixel electrode 12 (such an electric potential being hereinafter referred to as "pixel electrode potential"), and PC denotes the electric potential of the common electrode 19 (such an electric potential being hereinafter referred to as "common electrode potential").

As shown in FIG. 3, the source voltage VS is an AC voltage whose magnitude relationship with the common voltage VC is reversed in a predetermined cycle and, specifically, is a rectangular wave. Further, FIG. 3 shows an example in which the source voltage VS is higher than the common voltage VC in an N frame and lower than the common voltage VC in an N+1 frame.

In the N frame, when the gate voltage VG changes from low to high, the TFT 31 is turned on, so that the source voltage VS is supplied to the pixel electrode 12. At this point in time, the source voltage VS is also supplied to the first end of the auxiliary capacitor 32, so that the auxiliary capacitor 32 is charged. Meanwhile, the common voltage VC is supplied to the common electrode 19. This causes the pixel electrode potential PP to be higher than the common electrode potential PC. Accordingly, a pixel voltage VLC1, which is a difference between the pixel electrode potential PP and the common electrode potential PC, is applied to the liquid crystal layer 15. Further, as mentioned above, the transmission of the pixel is determined by the magnitude of this pixel voltage VLC1.

After that, when the gate voltage VG changes from high to low, the TFT 31 is turned off. However, since the auxiliary capacitor 32 is charged, a fluctuation in the pixel electrode potential PP is reduced.

Next, in the N+1 frame, when the gate voltage VG changes from low to high, the TFT 31 is turned on, so that the source voltage VS is supplied to the pixel electrode 12 and the auxiliary capacitor 32 is charged. Further, the common voltage VC is supplied to the common electrode 19. This causes the pixel electrode potential PP to be lower than the common electrode potential PC. Accordingly, a pixel voltage VLC2, which is a difference between the pixel electrode potential PP and the common electrode potential PC, is applied to the liquid crystal layer 15. Note, however, that the pixel voltage VLC2 in the N+1 frame is different in polarity from the pixel voltage VLC1 in the N frame.

After that, when the gate voltage VG changes from high to low, the TFT 31 is turned off. However, since the auxiliary capacitor 32 is charged, a fluctuation in the pixel electrode potential PP is reduced.

Incidentally, in the liquid crystal panel 1 shown in FIG. 1, the seal 16, the insulating film 13, the overcoat film 18, the filter 20*d*, and the like are constituted by resin. Therefore, moisture may penetrate into the liquid crystal layer 15 through these members especially in a high-humidity environment. Normally, tap water and moisture in the atmosphere contain positive ions 100 such as sodium ions, calcium ions, and magnesium ions and negative ions 101 such as chloride ions, sulfate ions, and nitrate ions but tend to contain more negative ions 101. Accordingly, while a user is using the liquid crystal panel 1, there may be an increase in concentration of negative ions 101 in the liquid crystal layer 15.

Moreover, negative ions 101 increased in the liquid crystal layer 15 are adsorbed to the lower alignment film 14, which is constituted by polyimide or the like, and come to cancel out positive charges that are supplied to the pixel electrode 12. Therefore, there is an increase in transmittance difference between the transmittance of the pixel before a reversal of polarity of the pixel voltage and the transmittance of the pixel after the reversal of polarity of the pixel voltage in a case where an AC voltage of a certain amplitude is supplied to the pixel electrode 12. That is, the common voltage VC, which is supplied to the common electrode 19, is brought into a state of divergence from the optimum common voltage. In other words, the optimum common voltage fluctuates from the original value. Note that the transmittance difference between the transmittance of the pixel before the reversal of polarity of the pixel voltage and the transmittance of the pixel after the reversal of polarity of the pixel voltage in a case where an AC voltage of a certain amplitude is supplied to the pixel electrode 12 is hereinafter referred to simply as "transmittance difference".

Such a fluctuation in optimum common voltage does not always take place uniformly all over the liquid crystal panel 1. For example, the amount of fluctuation in optimum common voltage in a peripheral portion into which moisture easily penetrates is larger than the amount of fluctuation in optimum common voltage in a central portion into which moisture hardly penetrates. This may cause a display unevenness in an image that the liquid crystal panel 1 displays.

Figure 4:
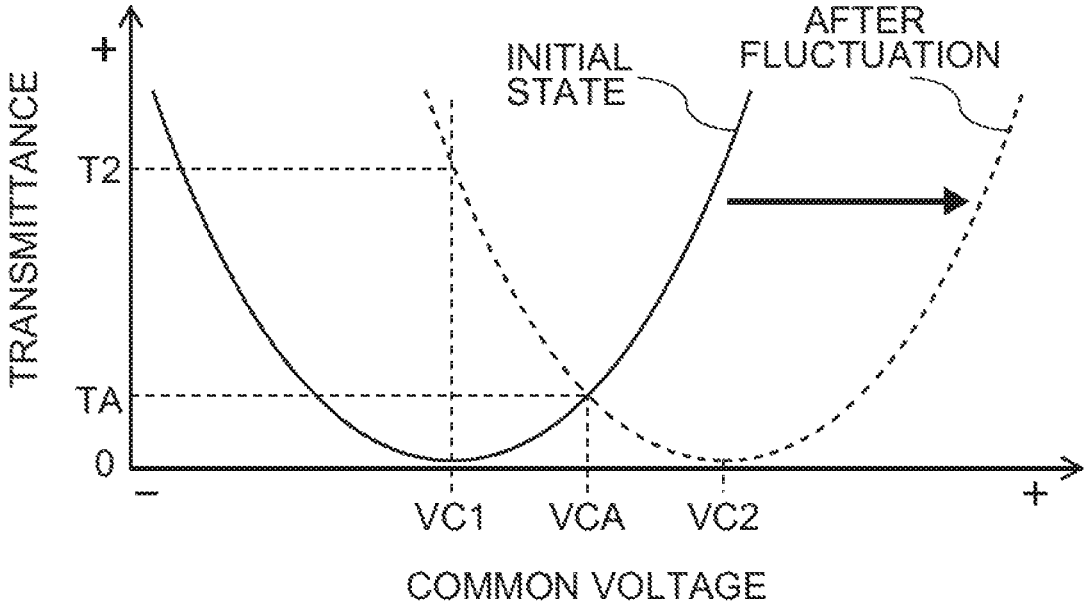
FIG. 4 is a diagram showing a relationship between a common voltage and a transmittance of a pixel.

FIG. 4 is a diagram showing a relationship between a common voltage and a transmittance of a pixel. In FIG. 4, the solid line indicates a relationship between an optimum common voltage and the transmittance in an initial state. The dotted line indicates a relationship between an optimum common voltage and the transmittance after a certain amount of fluctuation in optimum common voltage due to the influence of external stress such as moisture penetration or an environmental factor. Further, in the graph shown in FIG. 4, the horizontal axis represents the common voltage, and the vertical axis represents the transmittance. Note that the optimum common voltage in the initial state is hereinafter referred to as "first optimum common voltage VC1" and the optimum common voltage after a certain amount of fluctuation due to the influence of external stress is hereinafter referred to as "second optimum common voltage VC2".

As shown in FIG. 4, the relationship between the common voltage VC and the transmittance is such that the transmittance is minimized when the common voltage VC is an optimum common voltage and the transmittance increases as the common voltage VC diverges from the optimum common voltage. Accordingly, the relationship between the common voltage VC and the transmittance is expressed by a bilaterally symmetric downwardly-convex curve that is symmetric about the optimum common voltage.

Normally, the common voltage VC is set to the first optimum common voltage VC1, which is an optimum common voltage at the time of shipment. However, there is a fluctuation in optimum common voltage from the first optimum common voltage VC1 to the second optimum common voltage VC2. Therefore, in a case where the common voltage VC has been set to the first optimum voltage VC1, a fluctuation in optimum common voltage from the first optimum common voltage VC1 to the second optimum common voltage VC2 causes the transmittance difference to monotonically increase to T2.

To address this problem, the liquid crystal panel 1 sets the common voltage VC to a voltage that is higher than the first optimum common voltage VC1 and lower than the second optimum common voltage VC2. In this case, a fluctuation in optimum common voltage from the first optimum common voltage VC1 to the second optimum common voltage VC2 causes the transmittance difference to increase after having decreased to the minimum value. Accordingly, in this case, the transmittance difference is maximized when the optimum common voltage is the first optimum common voltage VC1 or the second optimum common voltage VC2; however, the transmittance difference at the time is smaller than T2.

Furthermore, in the liquid crystal panel 1, it is especially preferable to set the common voltage VC to an average voltage VCA, which is the average of the first optimum common voltage VC1 and the second optimum common voltage VC2. The transmittance difference in this case is described below.

Figure 5:
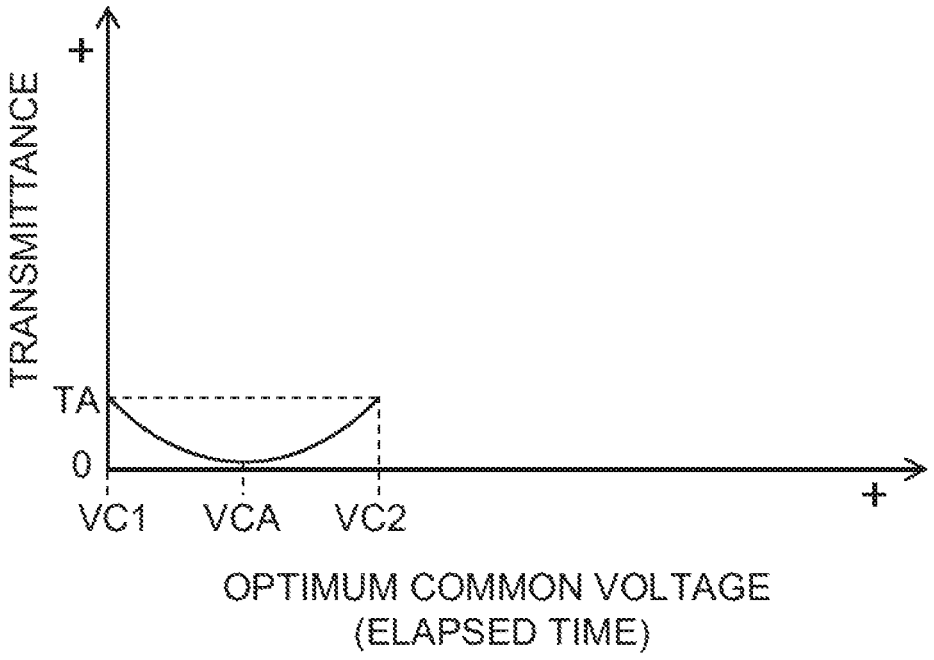
FIG. 5 is a graph showing a fluctuation in transmittance difference in a case where a common voltage VC has been set to a voltage VCA.

FIG. 5 is a graph showing a fluctuation in transmittance difference in a case where the common voltage VC has been set to the average voltage VCA. Further, in the graph shown in FIG. 5, the horizontal axis represents the optimum common voltage, and the vertical axis represents the transmittance difference. Note that since the optimum common voltage fluctuates by monotonically increasing from the first optimum common voltage VC1 to the second optimum common voltage VC2, the horizontal axis can be construed as representing elapsed time.

As shown in FIG. 5, when the common voltage VC is set to the average voltage VCA, the transmittance difference TA is reached when the optimum common voltage is the first optimum common voltage VC1 in the initial state; however, the transmittance difference decreases as the optimum common voltage increases, and the transmittance difference reaches its minimum value when the optimum common voltage has been set to the average voltage VCA. After that, the transmittance difference increases as the optimum common voltage increases; however, even in a case where the optimum common voltage has reached the second optimum common voltage VC2, the transmittance difference increases only up to the transmittance difference TA.

Thus, when the common voltage VC is set to the average voltage VCA, the maximum value of the transmittance difference is the transmittance difference TA even if the optimum common voltage fluctuates. Meanwhile, when the common voltage VC is set to a value far away from the average voltage VCA, the transmittance difference becomes greater than TA when the optimum common voltage is the first optimum common voltage VC1 or the second optimum common voltage VC2. That is, the maximum value of the transmittance difference is minimized by setting the common voltage VC to the average voltage VCA.

Figure 6:
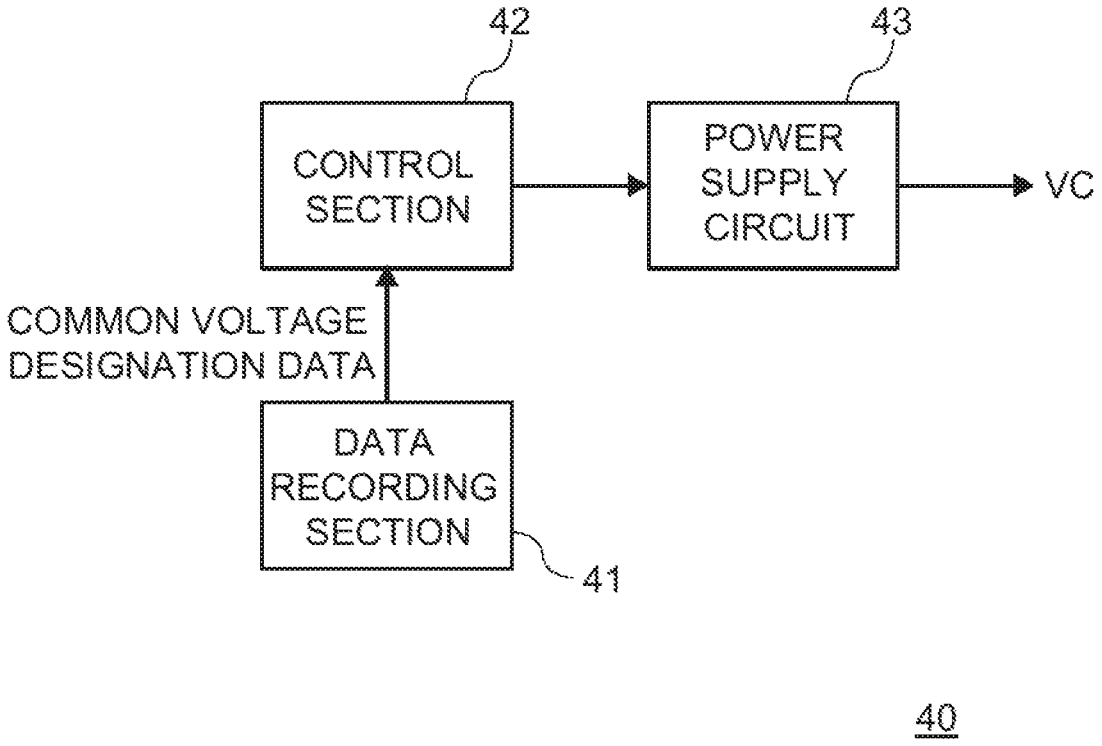
FIG. 6 is a block diagram showing a configuration of a common voltage generation section 50.

The following describes a method for setting the common voltage VC. FIG. 6 is a block diagram showing a configuration of a common voltage generation section 50. As shown in FIG. 6, the common voltage generation section 50 includes a data recording section 41, a control section 42, and a power supply circuit 43. The data recording section 41 is constituted by a storage device such as a semiconductor memory. The control section 42 is constituted, for example, by an IC (integrated circuit) for use in power supply control. The power supply circuit 43 is constituted by a voltage adjustment circuit such as a step-up circuit or a step-down circuit. Note that the data recording section 41 may be constituted by a part of the control section 41 (e.g. a register contained in the IC).

The control section 42 controls the power supply circuit 43 in accordance with common voltage designation data recorded in the data recording section 41. This generates the common voltage VC, whose magnitude corresponds to a value of the common voltage designation data. Further, the common voltage designation data is written to the data recording section 41, for example, at the time of assembly of the liquid crystal panel 1 or the liquid crystal display device.

Figure 7:
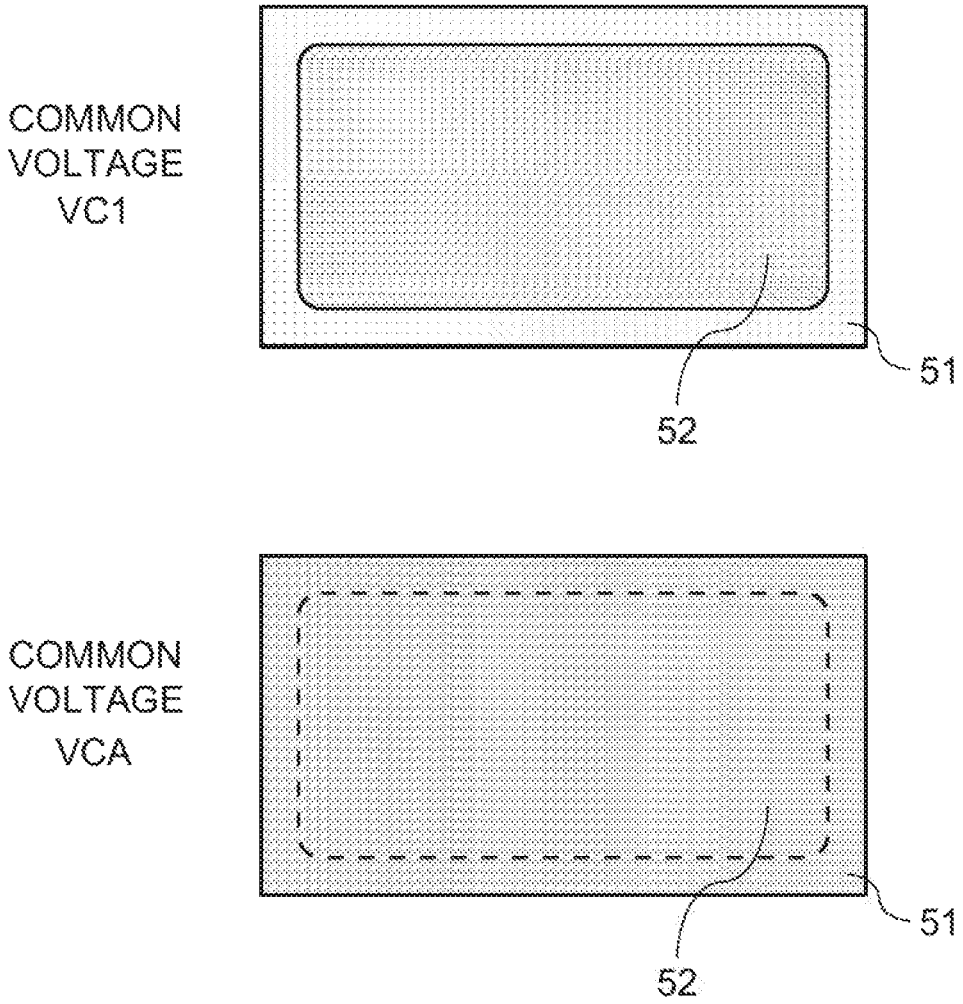
FIG. 7 is a schematic view showing a state of display in a case where the common voltage VC has been set to a first optimum common voltage and a state of display in a case where the common voltage VC has been set to the voltage VCA.

FIG. 7 is a schematic view showing a screen of the liquid crystal panel 1 in a case where the common voltage VC has been set to the first optimum common voltage VC1 and the screen of the liquid crystal panel 1 in a case where the common voltage VC has been set to the average voltage VCA. FIG. 7 shows the screen of the liquid crystal panel 1 in a case where the liquid crystal panel 1 has been exposed for 500 hours to a high-temperature and high-humidity environment whose temperature is 60 degrees and whose relative humidity is 95%.

As shown in FIG. 7, in a case where the liquid crystal panel 1 is exposed to an environment in which moisture penetrates into the liquid crystal layer 15, setting the common voltage VC to the first optimum common voltage VC1 causes a display unevenness to take place between the peripheral portion 51 and the central portion 52. A reason for this is that while the optimum common voltage greatly fluctuates and the transmittance difference increases to T2 in the peripheral portion 51, into which moisture easily penetrates, the optimum common voltage does not fluctuate as much and the transmittance difference is kept small in the central portion 52, into which moisture hardly penetrates, so that the peripheral portion 51 and the central portion 52 differ greatly from each other.

Meanwhile, in a case where the common voltage VC has been set to the average voltage VCA, no display unevenness takes place between the peripheral portion 51 and the central portion 52. A reason for this is that since the maximum value of the transmittance difference is minimized by setting the common voltage VC to the average voltage VCA, the transmittance difference increases only up to TA even if the optimum common voltage fluctuates in the peripheral portion 51, into which moisture easily penetrates, and differs little from a transmittance difference in the central portion 52.

As noted above, in the liquid crystal panel 1, the common voltage VC is a voltage that is higher than the first optimum common voltage VC1 and lower than the second optimum common voltage VC2. In this case, even if the optimum common voltage fluctuates, the transmittance difference can be made smaller than the transmittance difference T2, at which the common voltage VC is the first optimum common voltage VC1. This makes it possible to reduce a flickering screen and a display unevenness on the liquid crystal panel 1.

Furthermore, in the liquid crystal panel 1, the maximum value of the transmittance difference can be minimized by setting the common voltage VC to the average voltage VCA. This makes it possible to effectively reduce a flickering screen and a display unevenness on the liquid crystal panel 1.

[Modifications]

The aforementioned embodiment is merely an illustration for carrying out the present invention. Therefore, the present invention is not limited to the aforementioned embodiment, and a proper modification of the aforementioned embodiment may be carried out without departing from the scope of the present invention.

For example, the aforementioned embodiment has illustrated a case where the liquid crystal panel 1 is exposed to an environment in which moisture penetrates into the liquid crystal layer 15 and the optimum common voltage fluctuates in a positive direction. However, this example is not intended to limit the type of environment to which the liquid crystal panel 1 is exposed or the direction in which the optimum common voltage fluctuates. For example, in a case where the optimum common voltage fluctuates in a negative direction, the common voltage VC needs only be set to a voltage that is lower than the first optimum common voltage and higher than the second optimum common voltage. Furthermore, in this case, too, it is especially preferable to set the common voltage VC to the average voltage of the first optimum common voltage VC1 and the second optimum common voltage VC2.

Further, the common electrode 19, may be commonly provided for all pixels, may be commonly provided for a plurality of pixels, or may be provided for each pixel as is the case with the pixel electrode 12.

Further, the second optimum common voltage VC2 can be found by a short-term test by placing the liquid crystal panel 1 in an environment that is harsher than an imaginable realistic usage environment. For example, by conducting a test in which the liquid crystal panel 1 is exposed to a high-temperature and high-humidity environment whose temperature is 60 degrees and whose relative humidity is 95%, the second optimum common voltage VC2 in a case where the liquid crystal panel 1 is used in an environment in which moisture penetrates into the liquid crystal layer 15 can be found by a short-term test. Accordingly, such a liquid crystal panel 1 can be easily manufactured.

The aforementioned liquid crystal panel can be described as follows.

There is provided a liquid crystal panel including: a liquid crystal layer having liquid crystals; a pixel electrode, provided for each pixel, to which an AC voltage is supplied; and a common electrode to which a common voltage of a certain magnitude is supplied, wherein a transmittance of the pixel is controlled by the pixel electrode and the common electrode controlling a pixel voltage that is applied to the liquid crystal layer, in a case where the AC voltage of a certain amplitude is supplied to the pixel electrode, an optimum common voltage fluctuates from a first optimum common voltage to a second optimum common voltage, the optimum common voltage being the common voltage that minimizes a transmittance difference between the transmittance of the pixel before a reversal of polarity of the pixel voltage and the transmittance of the pixel after the reversal of polarity of the pixel voltage, and the common voltage is a voltage that is higher than the first optimum common voltage and lower than the second optimum common voltage or a voltage that is lower than the first optimum common voltage and higher than the second optimum common voltage (first configuration).

This configuration makes it possible to, even if the optimum common voltage fluctuates, make the transmittance difference smaller than it is in a case where the common voltage is the first optimum common voltage. This makes it possible to reduce a flickering screen and a display unevenness on the liquid crystal panel.

Further, in the first configuration, the common voltage may be an average voltage of the first optimum common voltage and the second optimum common voltage (second configuration). This configuration makes it possible to minimize the maximum value of the transmittance difference that fluctuates with the optimum common voltage. This makes it possible to effectively reduce a flickering screen and a display unevenness on the liquid crystal panel.

Further, in the first or second configuration, the second optimum common voltage is the optimum common voltage at which a certain amount of voltage fluctuation occurs due to a change in quality of the liquid crystal layer caused by penetration of moisture into the liquid crystal layer, and the common voltage is a voltage that is higher than the first optimum common voltage and lower than the second optimum common voltage (third configuration). This configuration makes it possible to reduce a flickering screen and a display unevenness of the liquid crystal panel even in an environment in which moisture penetrates into the liquid crystal layer.

Further, in the third configuration, the second optimum common voltage may be the optimum common voltage at which a certain amount of voltage fluctuation occurs in an environment whose temperature is 60 degrees and whose relative humidity is 95% (fourth configuration). This configuration makes it possible to find the second optimum common voltage by a short-term test by placing the liquid crystal panel in an environment that is harsher than an imaginable realistic usage environment, thus making it possible to easily manufacture the liquid crystal panel.

What is claimed is:

1. A liquid crystal panel comprising:

a liquid crystal layer having liquid crystals;

a pixel electrode, provided for each pixel, to which an AC voltage is supplied; and a common electrode to which a common voltage of a certain magnitude is supplied, wherein a transmittance of the pixel is controlled by the pixel electrode and the common electrode controlling a pixel voltage that is applied to the liquid crystal layer, in a case where the AC voltage of a certain amplitude is supplied to the pixel electrode, an optimum common voltage fluctuates from a first optimum common voltage to a second optimum common voltage, the optimum common voltage being the common voltage that minimizes a transmittance difference between the transmittance of the pixel before a reversal of polarity of the pixel voltage and the transmittance of the pixel after the reversal of polarity of the pixel voltage, and the common voltage is a voltage that is higher than the first optimum common voltage and lower than the second optimum common voltage or a voltage that is lower than the first optimum common voltage and higher than the second optimum common voltage.

2. The liquid crystal panel according to claim 1, wherein the common voltage is an average voltage of the first optimum common voltage and the second optimum common voltage.

3. The liquid crystal panel according to claim 1, wherein the second optimum common voltage is the optimum common voltage at which a certain amount of voltage fluctuation occurs due to penetration of moisture into the liquid crystal layer, and the common voltage is a voltage that is higher than the first optimum common voltage and lower than the second optimum common voltage.

4. The liquid crystal panel according to claim 3, wherein the second optimum common voltage is the optimum common voltage at which a certain amount of voltage fluctuation occurs in an environment whose temperature is 60 degrees and whose relative humidity is 95%.

* * * * *